US007587922B2

(12) United States Patent
Matsumoto

(10) Patent No.: US 7,587,922 B2
(45) Date of Patent: Sep. 15, 2009

(54) HEMMING MACHINE AND INSPECTING METHOD THEREOF

(75) Inventor: Yasuyuki Matsumoto, Fujisawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 262 days.

(21) Appl. No.: 11/704,915

(22) Filed: Feb. 12, 2007

(65) Prior Publication Data

US 2007/0193325 A1 Aug. 23, 2007

(30) Foreign Application Priority Data

Feb. 17, 2006 (JP) ..... 2006-041240

(51) Int. Cl.
*B21D 11/00* (2006.01)
*B21J 7/46* (2006.01)
*B21J 9/18* (2006.01)

(52) U.S. Cl. ..... 72/319; 72/450; 72/444

(58) Field of Classification Search ..... 72/312, 72/313, 319, 320, 321, 444, 450, 452.4–452.6
See application file for complete search history.

(56) References Cited

U.S. PATENT DOCUMENTS 4,346,579 A * 8/1982 Takatsu ..... 72/314
2001/0022101 A1 9/2001 Hario et al.
2004/0206149 A1 10/2004 Hario et al.
2006/0168789 A1 * 8/2006 Sasahara ..... 29/281.1

FOREIGN PATENT DOCUMENTS

JP 2001-286953 10/2001
JP 2003-251417 9/2003
WO WO 2004087347 A1 * 10/2004

* cited by examiner

*Primary Examiner*—Dana Ross
*Assistant Examiner*—Teresa M Bonk
(74) *Attorney, Agent, or Firm*—Global IP Counselors, LLP

(57) ABSTRACT

A hemming machine is provided with a frame, a hemming tool support structure and a swinging drive structure. The hemming tool support structure is rotatably coupled to the frame to rotate about a center rotation axis. The hemming tool support structure includes a hemming tool disposed at a first location such that the hemming tool moves towards and away from an edge part of a workpiece that is supported on a die upon rotation of the hemming tool support structure. The swinging drive structure transmits a rotational driving force to the hemming tool support structure via a releasable connection located on a side of the center rotation axis that is opposite of the hemming tool. The releasable connection is configured to release the swinging drive structure to allow further rotational movement of the hemming tool away from the die.

10 Claims, 15 Drawing Sheets

HEMMING MACHINE AND INSPECTING METHOD THEREOF

CROSS-REFERENCE TO RELATED APPLICATIONS

This application claims priority to Japanese Patent Application No. 2006-041240, filed on Feb. 17, 2006. The entire disclosure of Japanese Patent Application No. 2006-041240 is hereby incorporated herein by reference.

BACKGROUND OF THE INVENTION

1. Field of the Invention

The present invention generally relates to a hemming machine, which hems an edge part of a workpiece, and an inspecting method thereof.

2. Background Information

A hemming machine is often used to bend a peripheral edge of a first panel over a peripheral edge of a second panel. One example of a conventional hemming machine is disclosed in Japanese Published Unexamined Patent Application No. 2003-251417. In this conventional hemming machine, a pre-hemming process and a main hemming process are performed by oscillating and moving a frame supporting a pre-hemming tool and a main hemming tool in a straight line using a toggle link mechanism. Furthermore, when performing the main hemming process, the pre-hemming tool is retracted from the frame away from a space between a workpiece and the main hemming tool, which is positioned above the pre-hemming tool.

The hemming operation involves first oscillating the frame in relation to a base so that the pre-hemming tool and the main hemming tool are located above an edge part of the workpiece, which is on a die. The frame is then moved downward in a straight line to bring the pre-hemming tool nearer to the workpiece and to perform a pre-hemming operation. Next, the pre-hemming tool is moved so that it is retracted from the frame. Now, the main hemming process is performed by drawing the main hemming tool, which is at a position that is higher than the pre-hemming tool, closer to the workpiece by moving the frame further in a straight line. The frame is guided at this time by a cam groove formed in the base, and is oscillated and moved in a straight line.

SUMMARY OF THE INVENTION

However, since the conventional hemming machine described above has a configuration in which the entire frame with a pre-hemming tool and a final hemming tool is moved using a cam groove, numerous steps are required in order to allow for easy inspection operation to be preformed. In particular, this conventional hemming machine has to be partially disassembled in order to obtain an opening angle between the die and the pre-hemming tool and the main hemming tool that is sufficient to allow for easy inspection operation. Accordingly, a substantial amount of labor is required to disassemble the apparatus in order to perform an inspection operation. Consequently, it is difficult to perform the work of inspecting the hemming machine, such as to adjust the pre-hemming tool and the main hemming tool.

One object of the present invention is to provide a hemming machine that is configured to simplify the work of inspecting a hemming machine.

In accordance with one aspect of the present invention, a hemming machine is provided that basically comprises a frame, a hemming tool support structure and a swinging drive structure. The hemming tool support structure is rotatably coupled to the frame to rotate about a center rotation axis. The hemming tool support structure includes a hemming tool disposed at a first location such that the hemming tool moves towards and away from an edge part of a workpiece that is supported on a die upon rotation of the hemming tool support structure about the center rotation axis. The swinging drive structure is operatively arranged between the frame and the hemming tool support structure to transmit a rotational driving force to the hemming tool support structure via a releasable connection located on a side of the center rotation axis that is opposite of the hemming tool. The releasable connection is configured to release the swinging drive structure to allow further rotational movement of the hemming tool away from the die.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
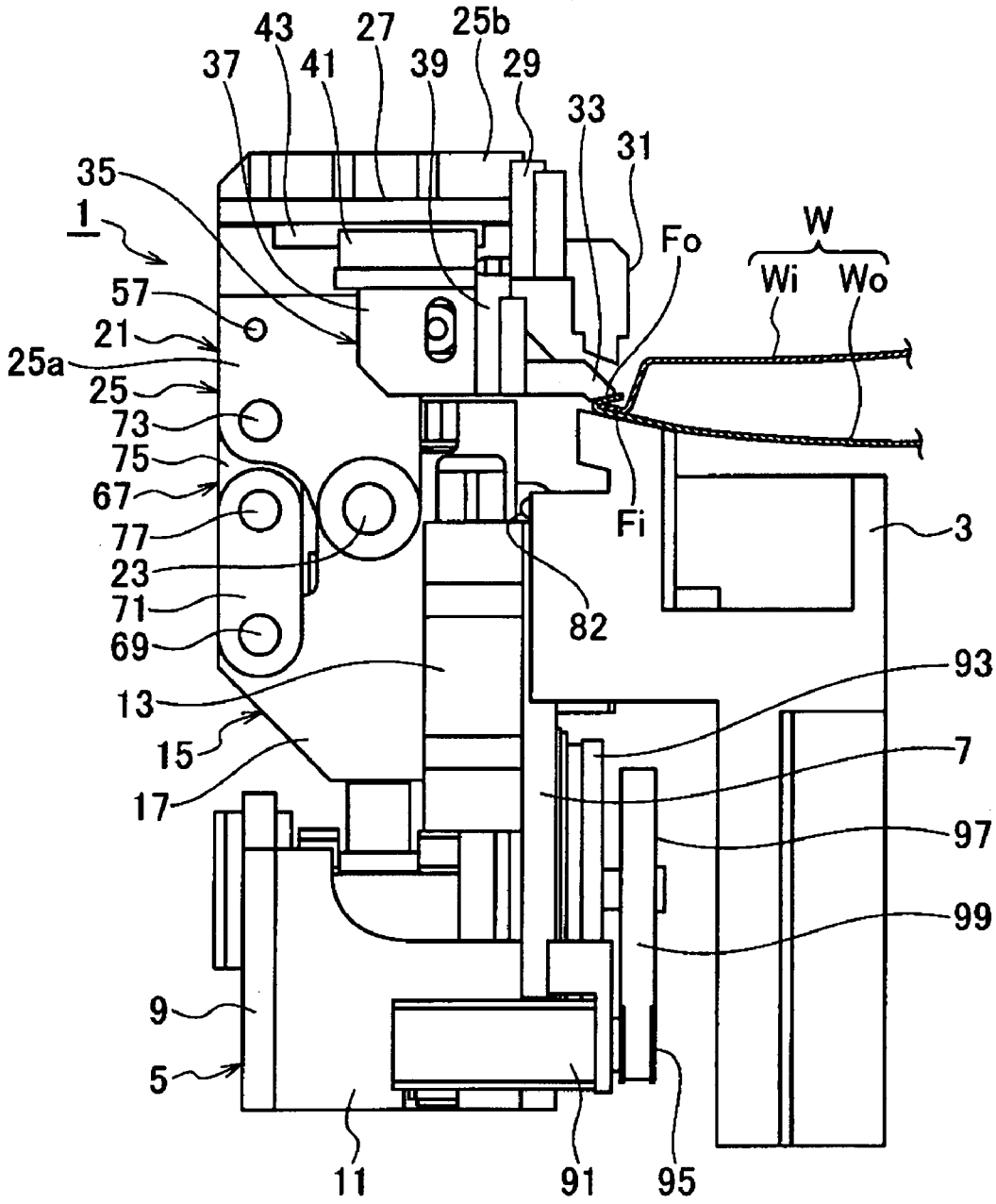
FIG. 1 is a front elevational view of a hemming machine in accordance with one preferred embodiment of the present invention in which the hemming machine is positioned in a state to begin the pre-hemming process.

Referring initially to FIG. 1, a hemming machine 1 is illustrated in accordance with a first embodiment of the present invention. A workpiece W is set on a die 3, which forms a lower mold, of the hemming machine 1, as shown in FIG. 1. The workpiece W is a door panel, which is, for example, a panel material of a vehicle body. The workpiece W has an inner panel Wi and an outer panel Wo. A hemming process is performed on the workpiece W so that an edge part Fo is folded at approximately 90° toward the outer panel Wo, overlaps an edge part Fi of the inner panel Wi. Furthermore, FIG. 1 shows a state in which a pre-hemming process is performed so that the abovementioned edge part Fo is bent from approximately 90° to approximately 45°. After the pre-hemming process, a final or main hemming process is performed so that the edge part Fo of the outer panel Wo overlaps the edge part Fi of the inner panel Wi.

Figure 6:
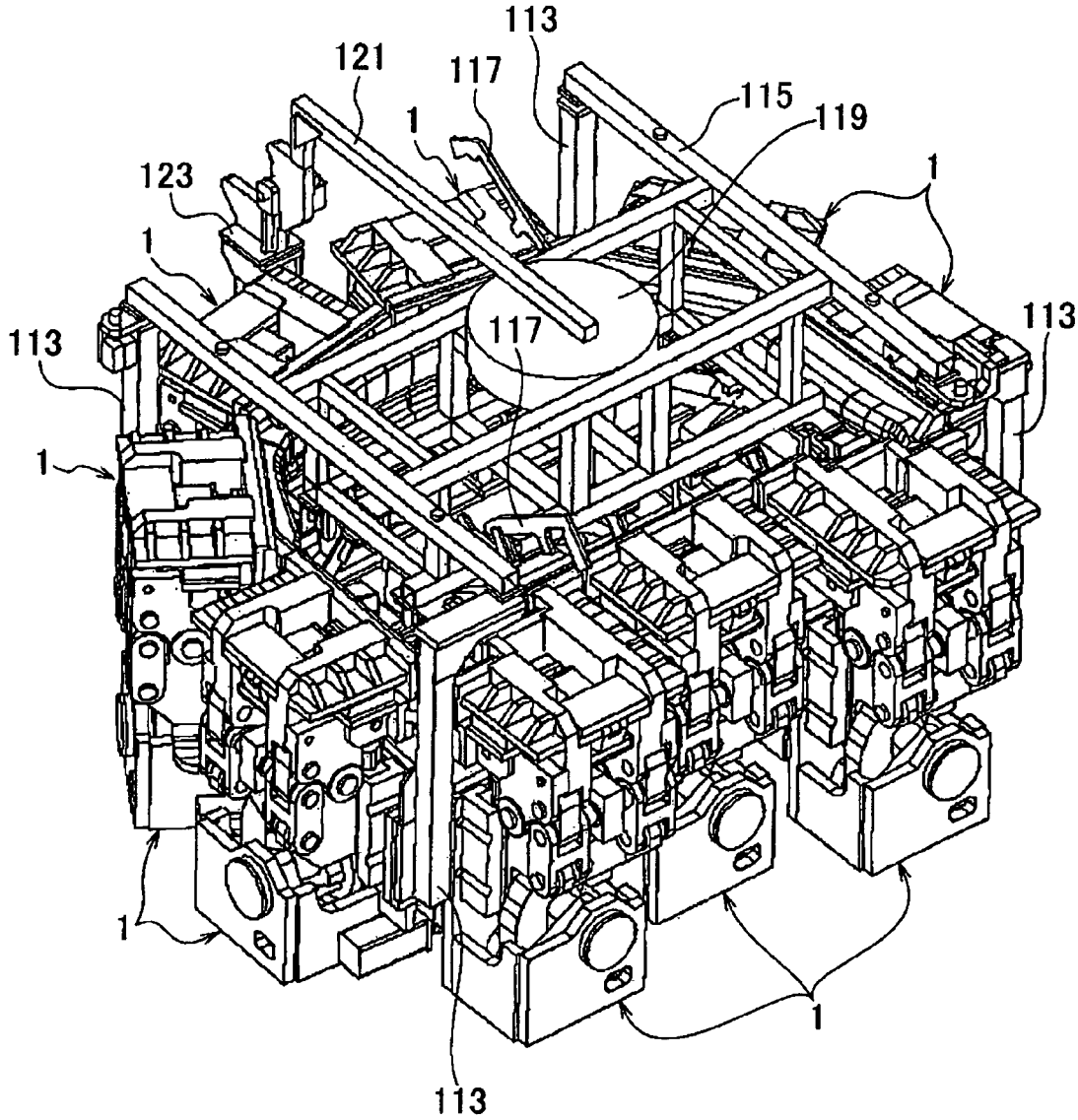
FIG. 6 is a perspective view of a plurality of hemming machines illustrated in FIGS. 1 to 5 in accordance with the illustrated embodiment of the present invention.

As shown in FIG. 6, several of the abovementioned hemming machines 1 are installed so that they surround the die 3, which is discussed later. The basic structures of these hemming machines 1 are completely identical to one another, and the hemming process is performed around the workpiece W by operating these hemming machines 1 simultaneously. Furthermore, the workpiece W is omitted from FIG. 6.

Figure 2:
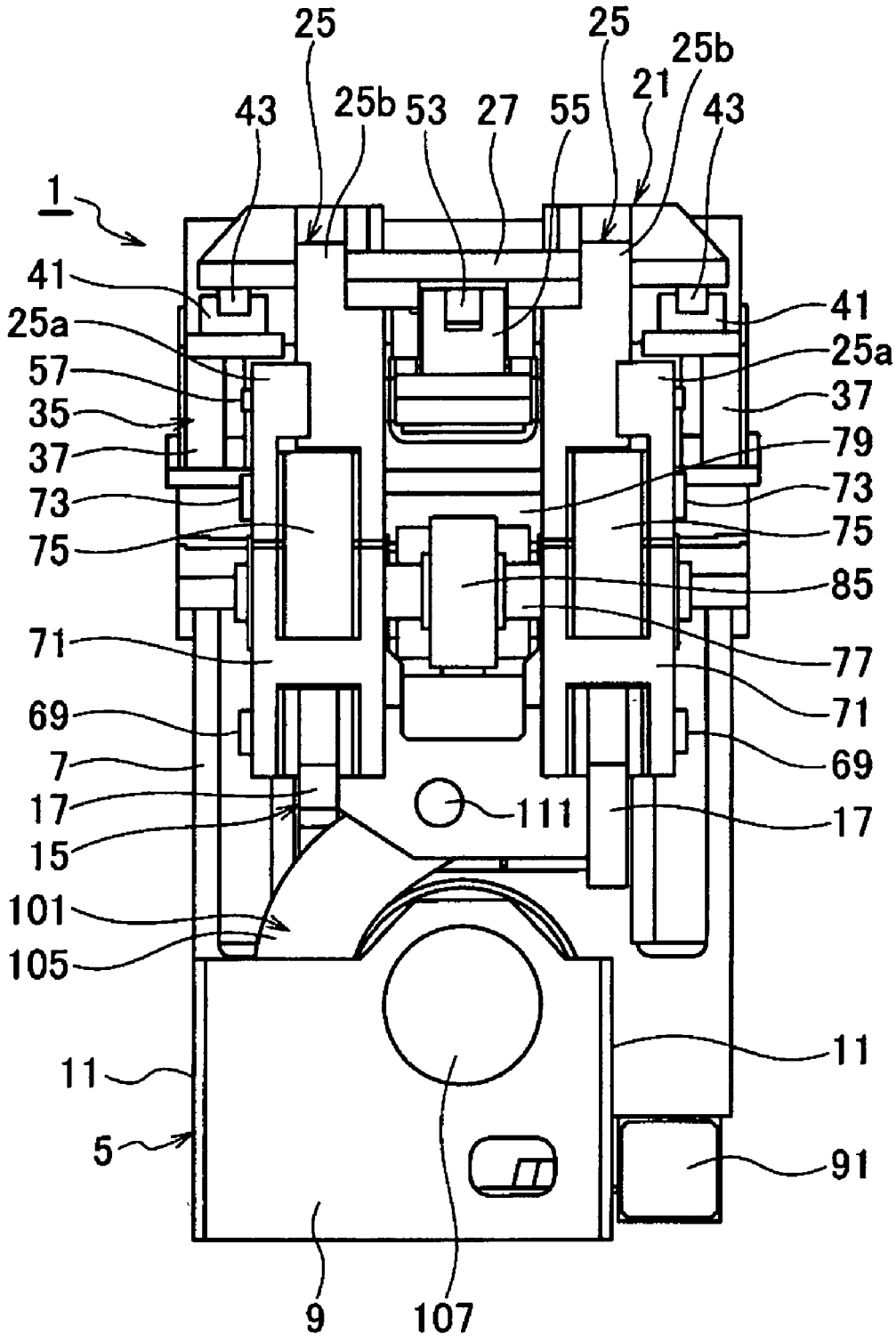
FIG. 2 is a left side elevational view of the hemming machine illustrated in FIG. 1 in accordance with the illustrated embodiment of the present invention.
Figure 3:
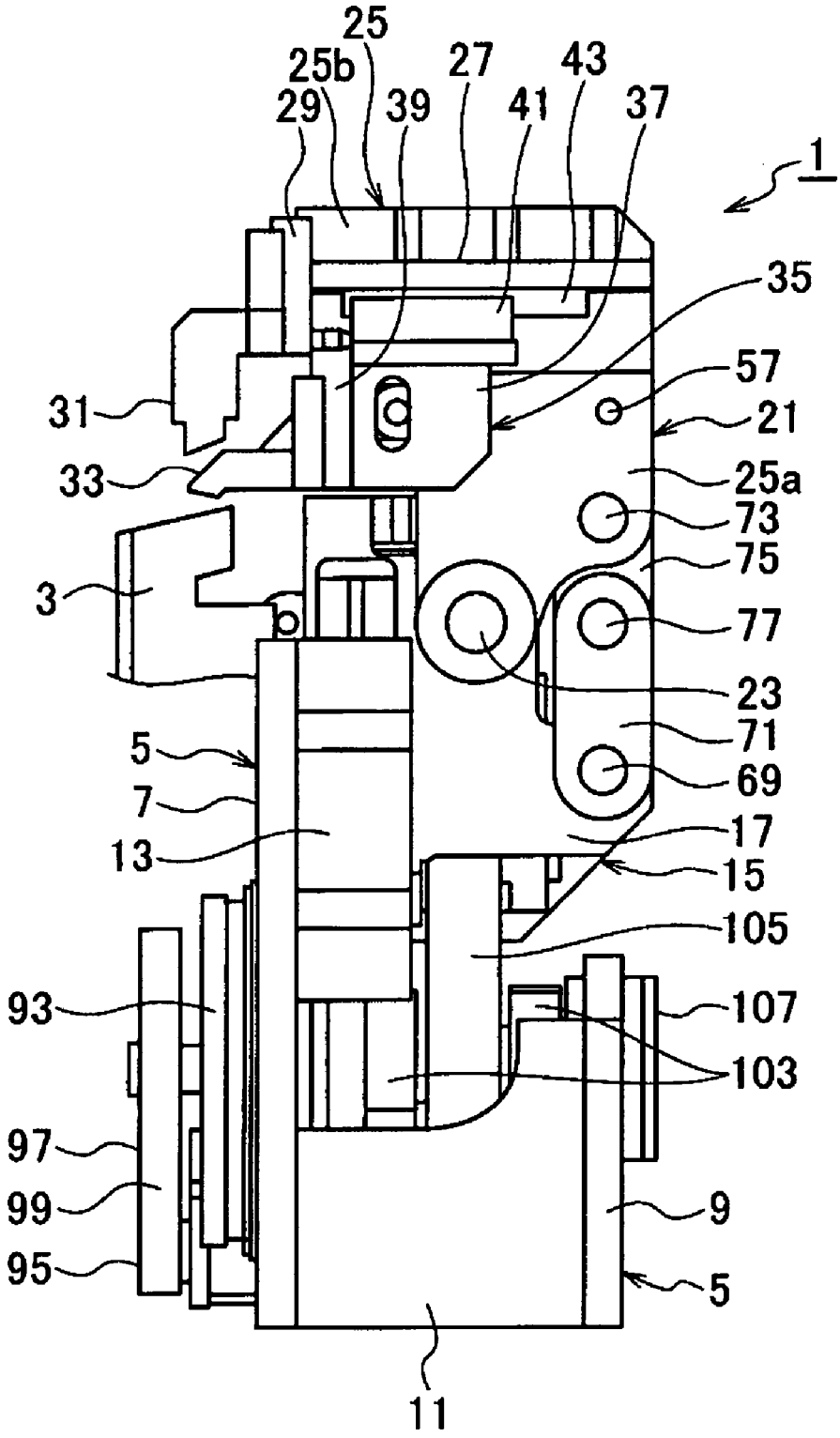
FIG. 3 is a partial rear elevational view of the hemming machine illustrated in FIGS. 1 and 2 in accordance with the illustrated embodiment of the present invention.
Figure 4:
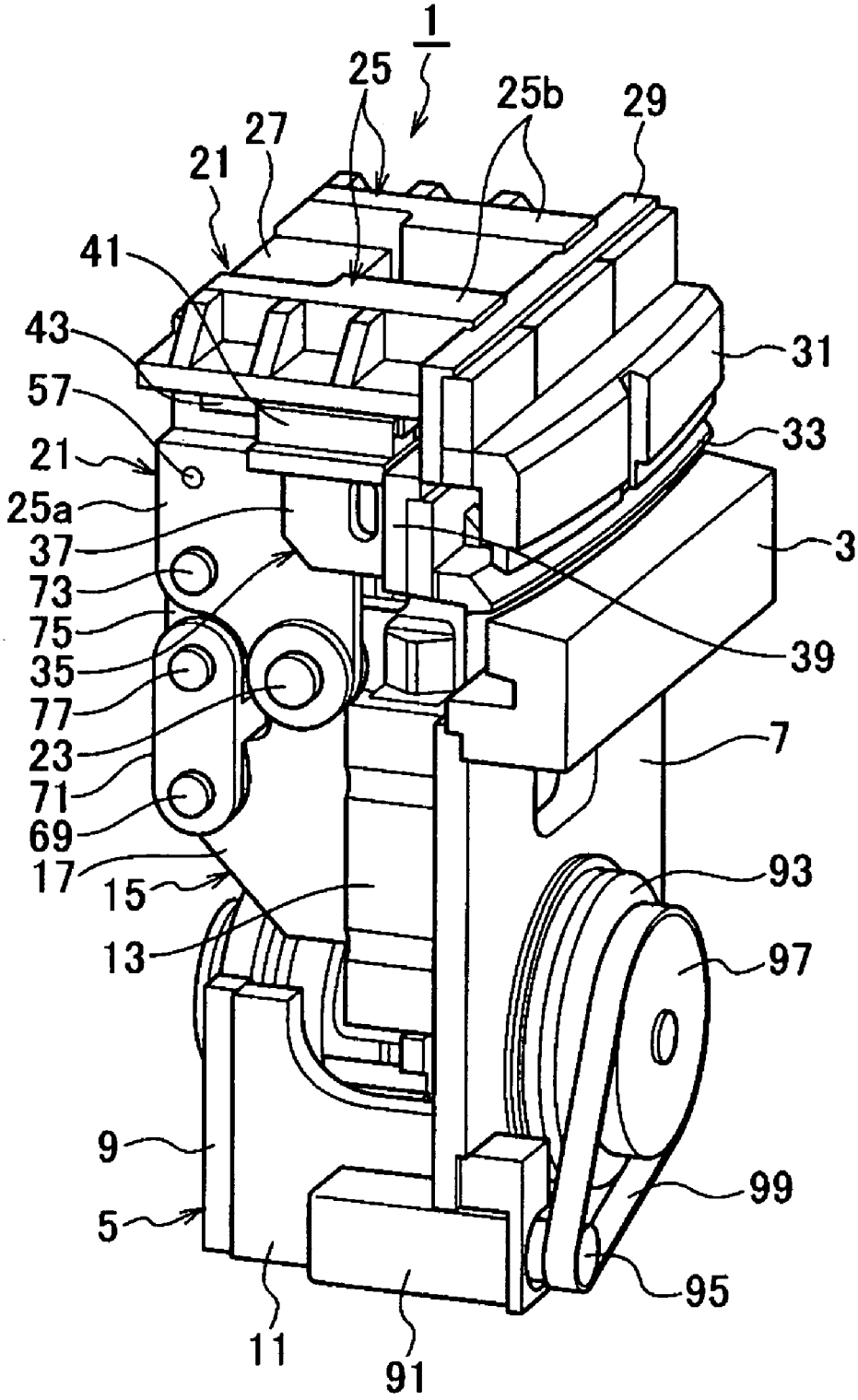
FIG. 4 is a partial front perspective view of the hemming machine illustrated in FIGS. 1 to 3 in accordance with the illustrated embodiment of the present invention as viewed from the upper right in FIG. 1.

The hemming machine 1 includes a main frame 5, which serves as a base platform of the hemming machine 1. As shown in FIGS. 1 and 4, the die 3 is installed to a side part of the main frame 5. The main frame 5 basically includes an inner side plate 7, an outer side plate 9 and a pair of connecting plates 11. The inner side plate 7 extends vertically and is adjacent to the die 3. The outer side plate 9 is installed parallel to and is shorter than the inner side plate 7. In particular, the outer side plate 9 is at a position so that it is spaced further from the die 3 than the inner side plate 7. The connecting plates 11 are coupled to both ends of the inner and outer side plates 7 and 9 in their width directions (the lateral direction in FIG. 2).

An upper part of the inner side plate 7 is provided with two frame guides 13, which correspond to positions that are substantially above the connecting plates 11. The two frame guides 13 face toward the outer side plate 9. The two frame guides 13 are provided so that a vertical slide frame 15, which serves as a frame, can be slid therebetween in a vertical direction.

Figure 9:
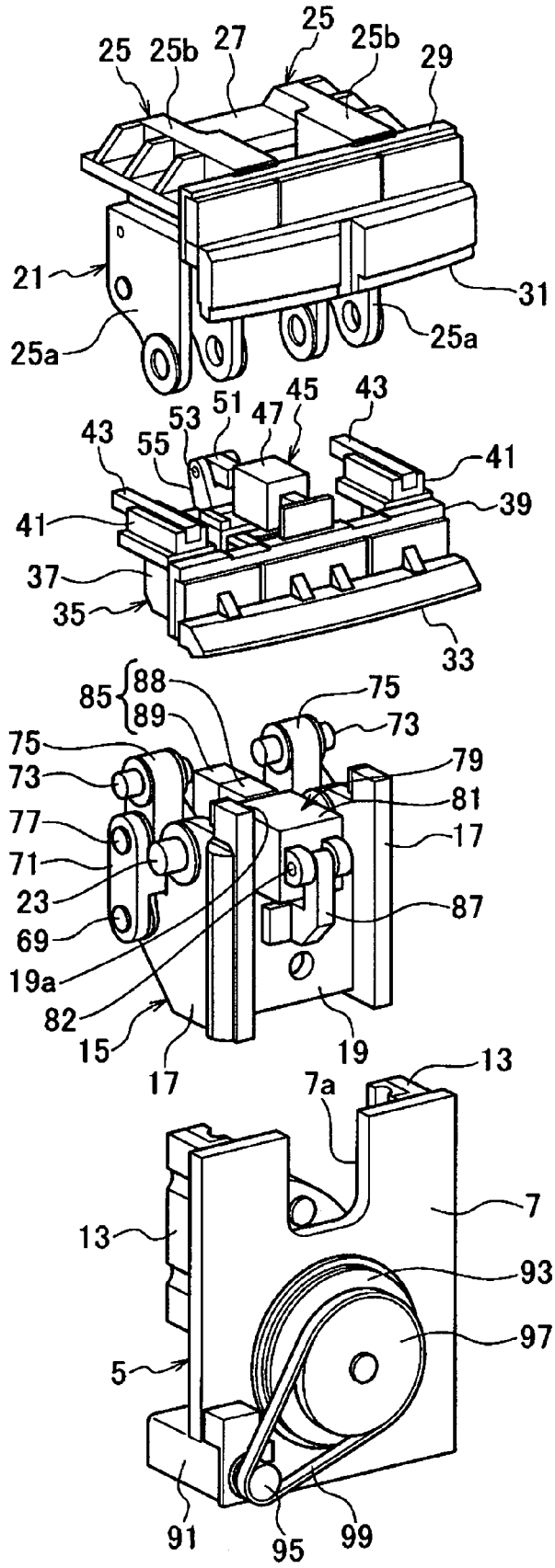
FIG. 9 is a partial exploded perspective view of the hemming machine illustrated in FIGS. 1 to 5 in accordance with the illustrated embodiment of the present invention.

The vertical slide frame 15 includes a pair of side plates 17 and a frame coupling plate 19 as seen in FIG. 9. The side plates 17 are parallel to and positioned on the inner sides of the connecting plates 11. The frame coupling plate 19 couples the side plates 17 together. The frame coupling plate 19 is provided in the vicinity of the inner side plate 7.

Figure 5:
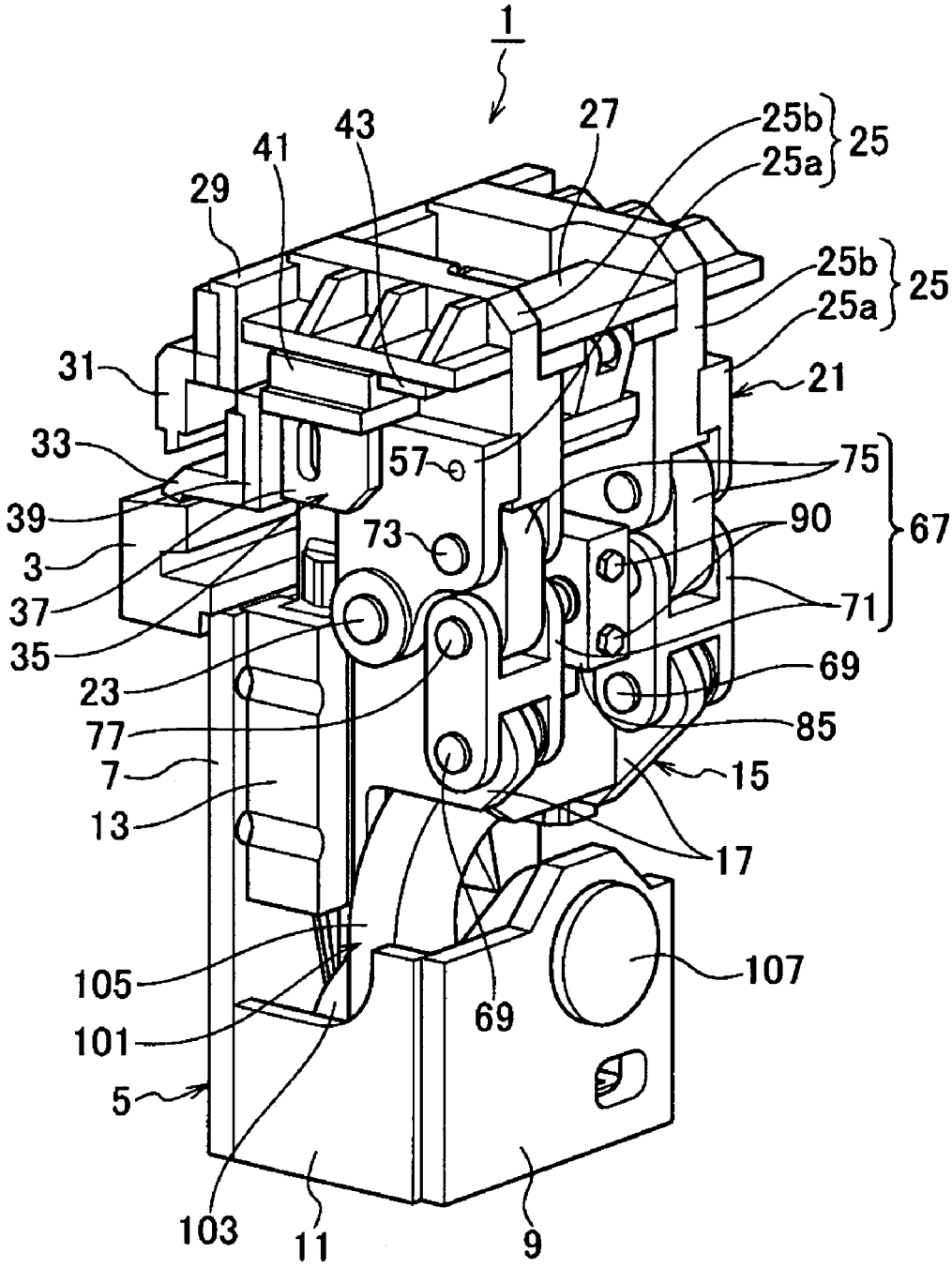
FIG. 5 is a partial rear perspective view of the hemming machine illustrated in FIGS. 1 to 4 in accordance with the illustrated embodiment of the present invention as viewed from the upper right in FIG. 3.

A hemming tool mounting bracket 21 is rotatably mounted to the upper parts of the side plates 17 by a pair of bracket coupling shafts 23 that defines a rotational center axis of the hemming tool mounting bracket 21. The hemming tool mounting bracket 21 serves as a hemming tool support structure. As shown in FIG. 5, the hemming tool mounting bracket 21 includes a pair of bracket side plates 25, a bracket upper coupling plate 27 and a bracket front coupling plate 29. The two bracket side plates 25 are coupled to the upper part of a corresponding one of the side plate 17. Each of the bracket side plates 25 includes an outer plate 25*a* and an inner plate 25*b*. The upper part of each side plate 17 is interposed between the lower parts of a corresponding pair of the outer and inner plates 25*a* and 25*b*. Thus, the outer and inner plates 25*a* and 25*b* sandwiches the side plates 17. Each of the inner plates 25*b* extends upward from the corresponding one of the outer plate 25*a*. The bracket upper coupling plate 27 couples the upper ends of the bracket side plates 25 together. The bracket front coupling plate 29 couples the front ends, i.e., the right sides in FIG. 1, of the bracket side plates 25 together.

Furthermore, a hemming tool 31 (also called hem blade) is provided to the end part of the bracket front coupling plate 29 on the die 3. The hemming tool 31 is used when performing the final main hemming process. In addition, prior to performing the main hemming process using the hemming tool 31, a pre-hemming tool 33 (also called pre-hem blade) is attached to a pre-hemming tool mounting bracket 35. The pre-hemming tool 33 is used when performing the pre-hemming process as shown in FIG. 1. The pre-hemming tool mounting bracket 35 includes a pair of bracket outer side plates 37 and a bracket coupling plate 39. The bracket outer side plates 37 are positioned on the outer sides of the bracket side plates 25. The bracket coupling plate 39 couples the end parts (i.e., their right sides in FIG. 1) of the bracket outer side plates 37 together. The pre-hemming tool 33 is attached to the front side (i.e., the right side in FIG. 1) of this bracket coupling plate 39. The abovementioned hemming tool 31 and pre-hemming tool 33 constitute the hemming tools.

The pre-hemming tool mounting bracket 35 further includes a pair of guide members 41. The guide members 41 are respectively provided above the bracket outer side plates 37 of the pre-hemming tool mounting bracket 35. The guide members 41 move along a pair of guide rails 43 disposed on the lower part of the bracket upper coupling plate 27 of the hemming tool mounting bracket 21. Thereby, the pre-hemming tool mounting bracket 35 can slide in the lateral direction of FIG. 1 with respect to the hemming tool mounting bracket 21. FIG. 1 shows a state, in which the pre-hemming process is being performed, with the pre-hemming tool mounting bracket 35 moved forward and the pre-hemming tool 33 positioned directly above the die 3.

Figure 7:
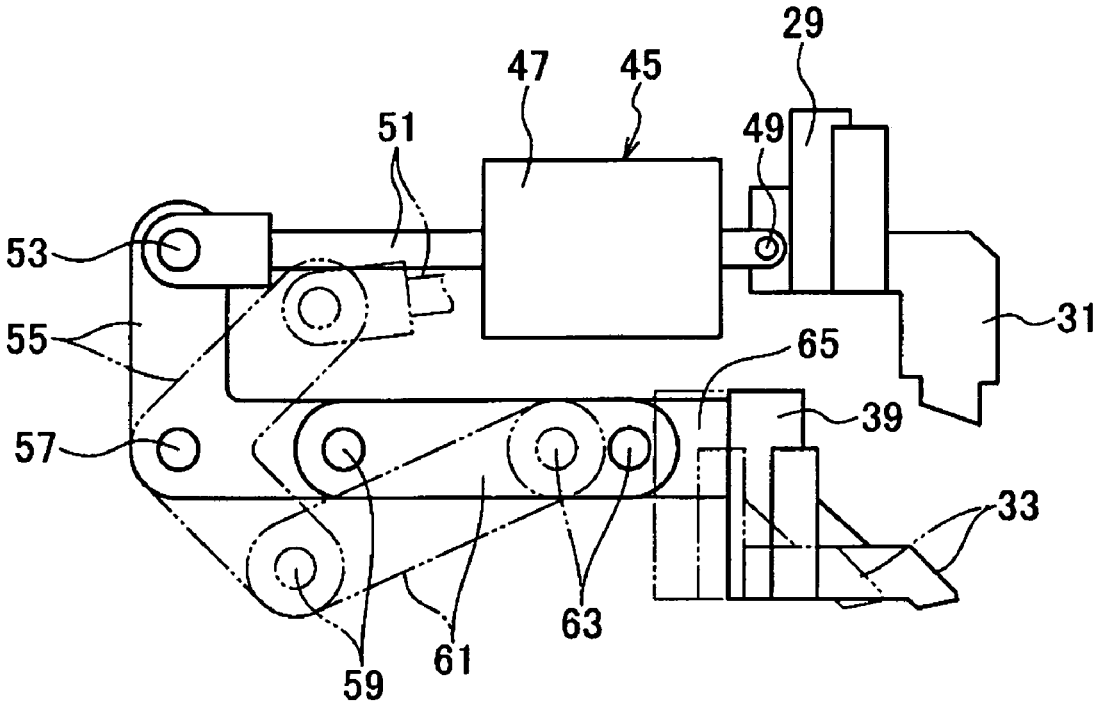
FIG. 7 is a simplified diagrammatic view of a drive mechanism for sliding a pre-hemming tool mounting bracket with respect to a hemming tool mounting bracket in accordance with the illustrated embodiment of the present invention.

FIG. 7 shows a driving mechanism that slides the pre-hemming tool mounting bracket 35 with respect to the hemming tool mounting bracket 21 to the state shown in FIG. 1. The driving mechanism includes a pre-hemming tool slide cylinder 45 having a cylinder body 47, a rotary support shaft 49, a piston rod 51 and a rotary support shaft 53. A rear end of the cylinder body 47 is rotatably coupled to the bracket front coupling plate 29 of the hemming tool mounting bracket 21 via the rotary support shaft 49. The piston rod 51 extends from the front of the pre-hemming tool slide cylinder 45. Meanwhile, one end of a bell crank 55 of the driving mechanism is rotatably coupled to a tip of the piston rod 51 via the rotary support shaft 53. One end of the bell crank 55 is rotatably supported by the bracket side plates 25 of the hemming tool mounting bracket 21 via a rotary center shaft 57. The other end of the bell crank 55 is rotatably coupled to one end of a linear link 61 via a rotary support shaft 59. The other end of the linear link 61 is rotatably coupled to a fixture 65, which is provided to the bracket coupling plate 39 via a rotary support shaft 63.

FIG. 7 corresponds to the state in FIG. 1, in which the piston rod 51 advances and the pre-hemming tool 33 is positioned above the die 3. If the piston rod 51 retracts from this state, then the bell crank 55 rotates clockwise in FIG. 7 about the rotary center shaft 57, as shown by the chain double dashed line. The linear link 61 rotates counterclockwise in FIG. 7 about the rotary support shaft 63 and simultaneously moves in the left direction of FIG. 7. Also with this movement of the linear link 61 in the left direction, the pre-hemming tool 33 also moves in the left direction of FIG. 7 and transitions to a state where it is spaced from the die 3.

The hemming tool mounting bracket 21 is rotatable about the bracket coupling shaft 23, as discussed earlier, with respect to the side plates 17 of the vertical slide frame 15. This rotational operation causes the hemming tool 31 and the pre-hemming tool 33, which is attached to the pre-hemming tool mounting bracket 35, to move close to or away from the workpiece W that is set on the die 3.

The following explains the mechanism that carries out the rotational operation of the hemming tool mounting bracket 21 about the bracket coupling shaft 23. As shown in FIG. 1, the side plates 17 of the vertical slide frame 15 and the bracket side plates 25 of the hemming tool mounting bracket 21 are coupled by a link mechanism 67 on the left side of the bracket coupling shaft 23.

The link mechanism 67 basically includes a pair of lower part links 71 and a pair of upper part links 75. Each of the lower part links 71 serves as a first link that is rotatably coupled at its lower end to a respective one of the side plates 17 of the vertical slide frame 15 via a rotary support shaft 69. Each of the upper part links 75 serves as a second link that is rotatably coupled one at its upper end to a respective one of the bracket side plates 25 of the hemming tool mounting bracket 21 via a rotary support shaft 73. Each of the lower part links 71 is rotatably coupled at its upper end to a respective one of the upper part links 75 by a link support shaft 77.

Figure 8:
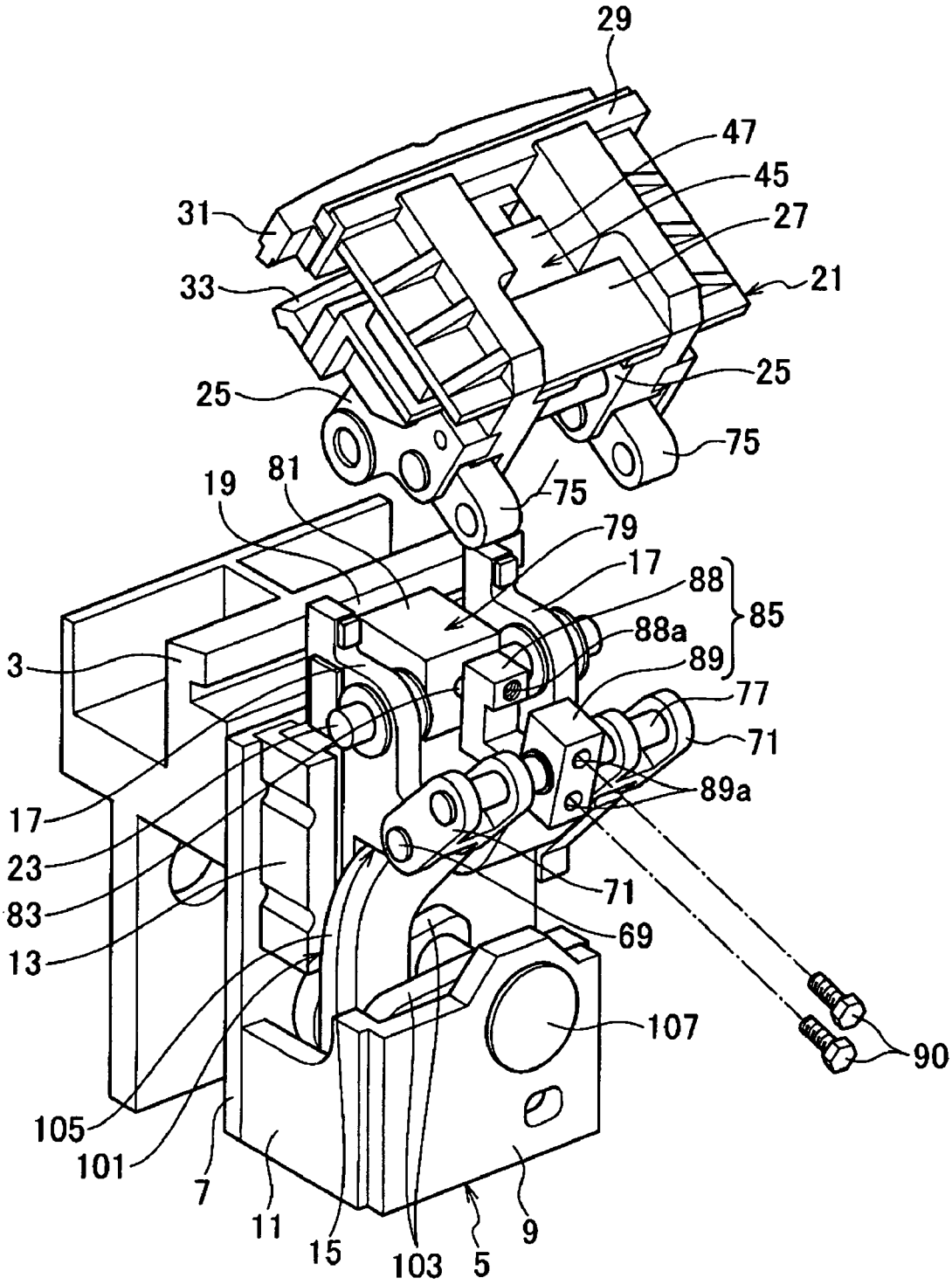
FIG. 8 is a partial exploded perspective view of the hemming machine illustrated in FIGS. 1 to 5, with the hemming tool mounting bracket removed from the vertical slide frame.

FIG. 8 is an exploded perspective view that shows a state in which the hemming tool mounting bracket 21 in the perspective view of FIG. 5 is removed from the vertical slide frame 15. The lower part links 71 are provided along the axial direction of the link support shaft 77, and the upper part links 75 are also provided along the axial direction of the link support shaft 77.

Meanwhile, a swing cylinder 79 is provided to rotate the hemming tool mounting bracket 21. The swing cylinder 79 serves as a swing driving structure. In particular, the swing cylinder 79 has a cylinder main body 81 with a rear end being rotatably attached to the frame coupling plate 19 via a cylinder rotary support shaft 82 as seen in FIG. 9. Thus, the swing cylinder 79 has a cylinder main body 81 is rotatably attached to the side plates 17 of the vertical slide frame 15 by the frame coupling plate 19. The swing cylinder 79 has a piston rod 83 that extends out of the cylinder main body 81 with a tip of the piston rod 83 being coupled to a clevis 85. The piston rod 83 serves as a drive rod, while the clevis 85 serves as a coupling member.

As seen in FIG. 9, an exploded perspective view, which excludes the die 3, shows selected portions of the hemming machine 1, in which the main frame 5 is detached from the vertical slide frame 15, which moves vertically along the frame guides 13 with respect to the main frame 5. Also, in FIG. 9, the hemming tool mounting bracket 21 is detached from the vertical slide frame 15 and the pre-hemming tool mounting bracket 35. The hemming tool mounting bracket 21 is normally attached to the vertical slide frame 15 to rotate about the bracket coupling shaft 23 with respect to the vertical slide frame 15. The pre-hemming tool mounting bracket 35 is normally attached to the hemming tool mounting bracket 21 such that the pre-hemming tool mounting bracket 35 slides via the guide members 41 with respect to the hemming tool mounting bracket 21.

Thereby, the swing cylinder 79 is disposed inside a notched recessed part 19*a*, which is provided to the upper part of the frame coupling plate 19 of the vertical slide frame 15, and a notched recessed part 7*a*, which is provided to the inner side plate 7 of the main frame 5. The swing cylinder 79 is rotatably supported on the cylinder rotary support shaft 82 at the rear end of the cylinder main body 81. The cylinder rotary support shaft 82 rotatably supported on a cylinder mounting unit 87, which is provided so that it protrudes from the frame coupling plate 19. The cylinder rotary support shaft 82 is attached so that it is parallel to the bracket coupling shaft 23. Consequently, when the hemming tool, mounting bracket 21 rotates about the bracket coupling shaft 23, the cylinder main body 81 rotates about the cylinder rotary support shaft 82, which makes it possible for the hemming tool mounting bracket 21 to operate smoothly.

Figure 10:
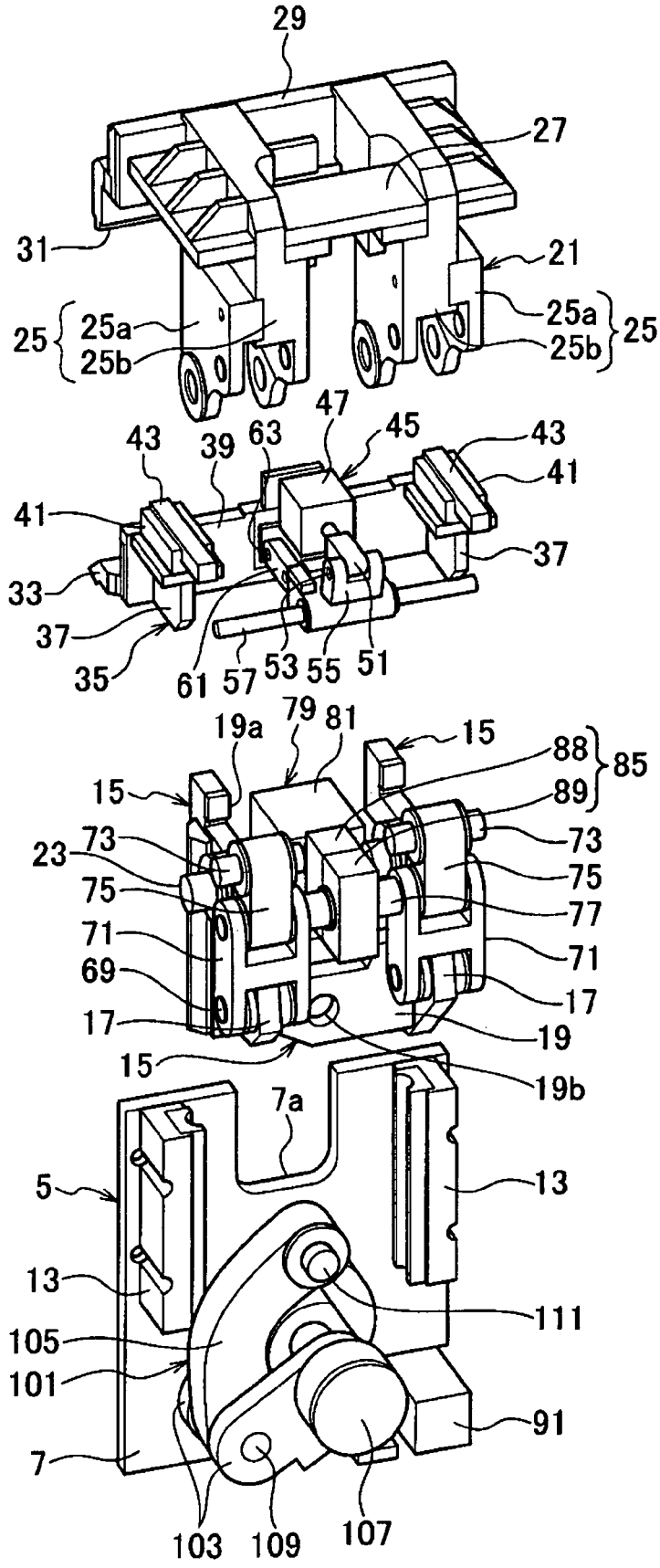
FIG. 10 is a partial exploded perspective view of the hemming machine illustrated in FIGS. 1 to 5 in accordance with the illustrated embodiment of the present invention, as viewed from the opposite side from FIG. 9.
Figure 11:
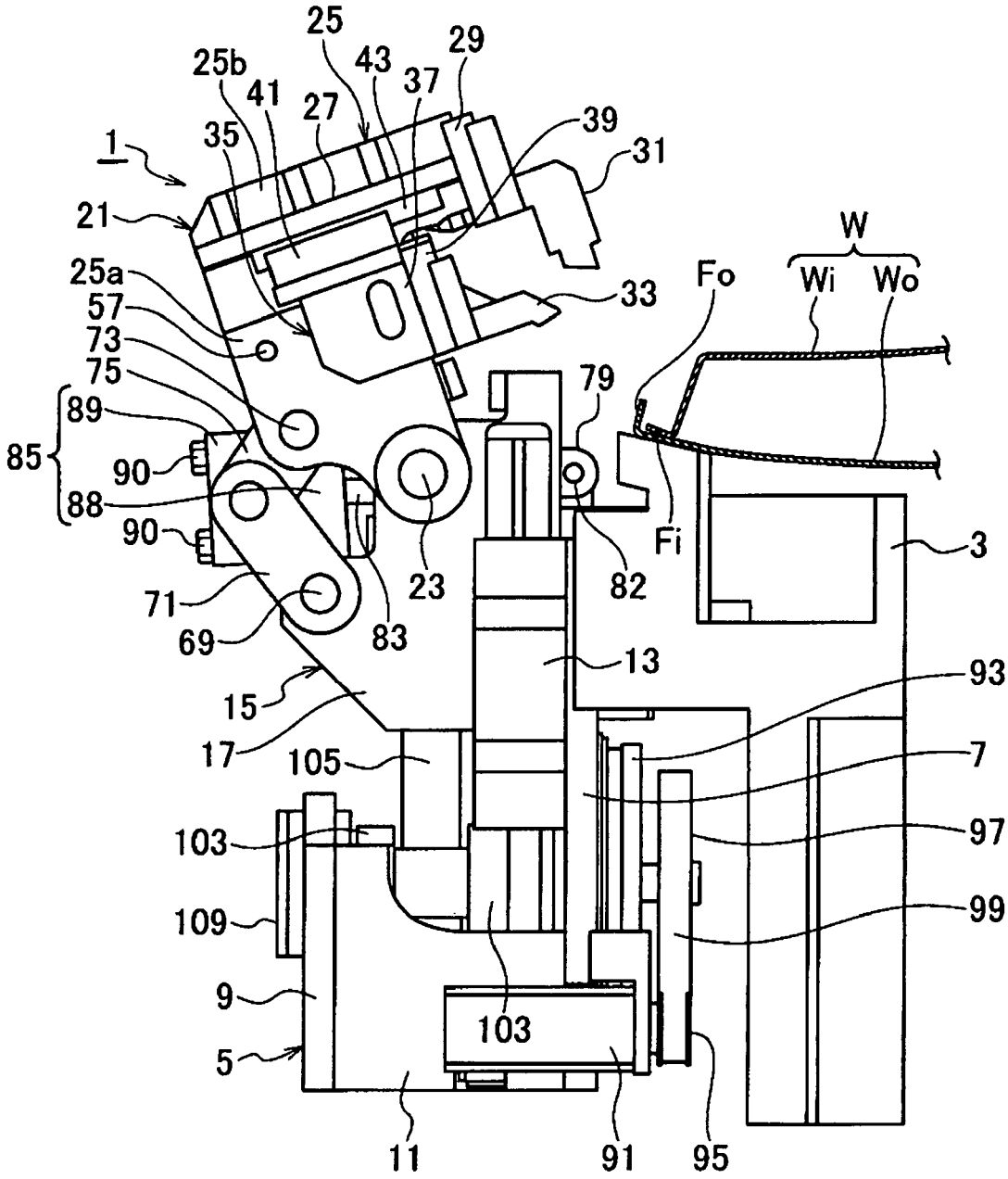
FIG. 11 is a front elevational view of the hemming machine illustrated in FIGS. 1 to 5 in accordance with the illustrated embodiment of the present invention, in which a workpiece loaded on the hemming machine to begin operation of the hemming machine.

Furthermore, FIG. 10 is an exploded perspective view, viewed from the far side of FIG. 9. The clevis 85 is divided into a segment member 88 and a segment member 89. The segment member 88 is coupled to the piston rod 83, while the segment member 89 is coupled to the link support shaft 77. In addition, these segment members 88 and 89 are joined by two bolts 90, which serve as a coupler. Two screw holes 88*a* are provided in the segment member 88 on the side of the piston rod 83. Two bolt insertion holes 89*a* are provided in the segment member 89 on the side of the link support shaft 77. These two segment members 88 and 89 are integrated by inserting the bolts 90 into the bolt insertion holes 89*a* and tightening them into the screw holes 88*a*. In so doing, the clevis 85 is moved in the left direction of FIG. 1 by the forward drive of the piston rod 83 in the swing cylinder 79. Furthermore, starting from the state in FIG. 1, the lower part links 71 rotate counterclockwise in FIG. 1 about the rotary support shafts 69 and the upper part links 75 rotate clockwise in FIG. 1 about the rotary support shafts 73. Thus, as shown in FIG. 11 (discussed later), the hemming tool mounting bracket 21 rotates counterclockwise about the bracket coupling shaft 23 and transitions to a state where it is open with respect to the die 3.

The following explains a mechanism in which the vertical slide frame 15 vertically moves the hemming tool mounting bracket 21 and the pre-hemming tool mounting bracket 35 with respect to the main frame 5.

As shown in FIG. 1 and in FIG. 4, a servomotor 91 is installed at the lower part of the coupling region between the inner side plate 7 of the main frame 5 and the connecting plates 11. The servomotor 91 serves as a hemming driving device. Meanwhile, a reduction gear 93 is installed on the inner side plate 7 on the side of the die 3. The servomotor 91 and the reduction gear 93 are provided with pulleys 95 and 97, respectively. These pulleys 95 and 97 are coupled by a timing belt 99. Furthermore, a planetary gear mechanism is used for the reduction gear 93.

In addition, as shown in FIG. 10, a toggle link mechanism 101 is provided to the inner side plate 7 on the side opposite the reduction gear 93. The toggle link mechanism 101 includes a pair of drive side linear links 103 and a follower side bent link 105. One end of each of the drive side linear links 103 is fixedly coupled to an output shaft 107 of the reduction gear 93. The other end of each of the drive side linear links 103 is rotatably coupled to one end of the follower side bent link 105 via a lower part coupling shaft 109. The other end of the follower side bent link 105 is rotatably coupled to a coupling hole 19*b* of the frame coupling plate 19 of the vertical slide frame 15 via an upper part coupling shaft 111.

Specifically, the drive side linear links 103 of the toggle link mechanism 101 rotate about the output shaft 107 of the reduction gear 93 by the drive of the servomotor 91 via the timing belt 99 and the reduction gear 93. This causes thee follower side bent link 105 to rotate about the upper part coupling shaft 111 and simultaneously move in the vertical direction. Also the vertical slide frame 15 moves vertically with respect to the main frame 5.

The vertical movement of the vertical slide frame 15 causes the hemming tool 31, which is provided to the hemming tool mounting bracket 21, and the pre-hemming tool 33, which is provided to the pre-hemming tool mounting bracket 35, to also move in the same direction, and thereby the main hemming process or the pre-hemming process is performed.

As shown in FIG. 6, a support stand 113 is installed at each of four locations that are between the hemming machines 1 disposed around the die 3. A work grasping hand 115 is fixed above the support stands 113. The work grasping hand 115 clamps the workpiece W, which is not shown in FIG. 6, by a plurality of work clamps 117 (which are in an unclamped state in FIG. 6). The work grasping hand 115 are coupled to an arm of a robot (not shown) via a hand changer, which is concealed by a hand changer cover 119 (located at the center upper part of the work grasping hand 115).

In a state where the robot moves and conveys the work grasping hand 115 with the workpiece W clamped thereto, the robot positions the work grasping hand 115 on the support stands 113 and fixes it thereto. The arm of the robot detaches from the hand changer and covers it with the hand changer cover 119. The hand changer cover 119 is attached to a tip of a rotary arm 121. The hand changer cover 119 rotates about a support platform 123, which is on the base end side of the rotary arm 121. The hand changer cover 119 also moves between a state wherein it covers the hand changer, as shown in FIG. 6, and a state wherein it is spaced apart from the hand changer and does not cover it.

The following explains the hemming operation using the abovementioned hemming machine 1. First, the swing cylinder 79 is driven forward and the hemming tool mounting bracket 21 transitions to a workpiece receiving state, as shown in FIG. 11. In this workpiece receiving state, the hemming tool mounting bracket 21 is wide open with respect to the die 3, whereupon the workpiece W is placed on the die 3. At this time, the pre-hemming tool 33 is in the retracted position shown by the chain double dashed line in FIG. 7. In addition, the workpiece W transitions to a state in which the outer panel Wo is the lower part and the inner panel Wi is placed thereupon. The edge part Fo of the outer panel Wo is upwardly bent at substantially 90°.

When setting the workpiece W on the die 3, the robot (not shown) transports and positions the work grasping hand 115, which grasps the workpiece W, on the support stands 113. After that positioning, the robot (not shown) releases the clamping of the workpiece W by the work clamps 117, as shown in FIG. 6. At this time, the workpiece W is easily loaded onto the die 3 because the hemming tool mounting bracket 21 opens at a large angle with respect to the die 3. Also the hemming tool 31 and the pre-hemming tool 33, which are at the retracted position, are wide open with respect to the die 3.

Next, starting from the state shown in FIG. 11, the rearward drive of the swing cylinder 79 moves the clevis 85 in the right direction in FIG. 11. This movement of the swing cylinder 79 rotates the lower part links 71 clockwise in FIG. 11 about the rotary support shafts 69 and also rotates the upper part links 75 counterclockwise in FIG. 11 about the rotary support shafts 73. Thus, these links 71 and 75 form a straight line in the vertical direction, as shown in FIG. 12.

Again, starting from the state shown in FIG. 11, the hemming tool mounting bracket 21 rotates clockwise about the bracket coupling shaft 23 by the rearward drive of the swing cylinder 79. Also the hemming tool 31 transitions so that it is at a position above the die 3. Additionally, the pre-hemming tool slide cylinder 45 is driven forward, and the pre-hemming tool 33 transitions to a state in which it is positioned forward, as shown by the solid line position in FIG. 7. The pre-hemming tool 33 is then positioned between the edge part Fo of the outer panel Wo on the die 3 and the hemming tool 31, as shown in FIG. 12.

Figure 12:
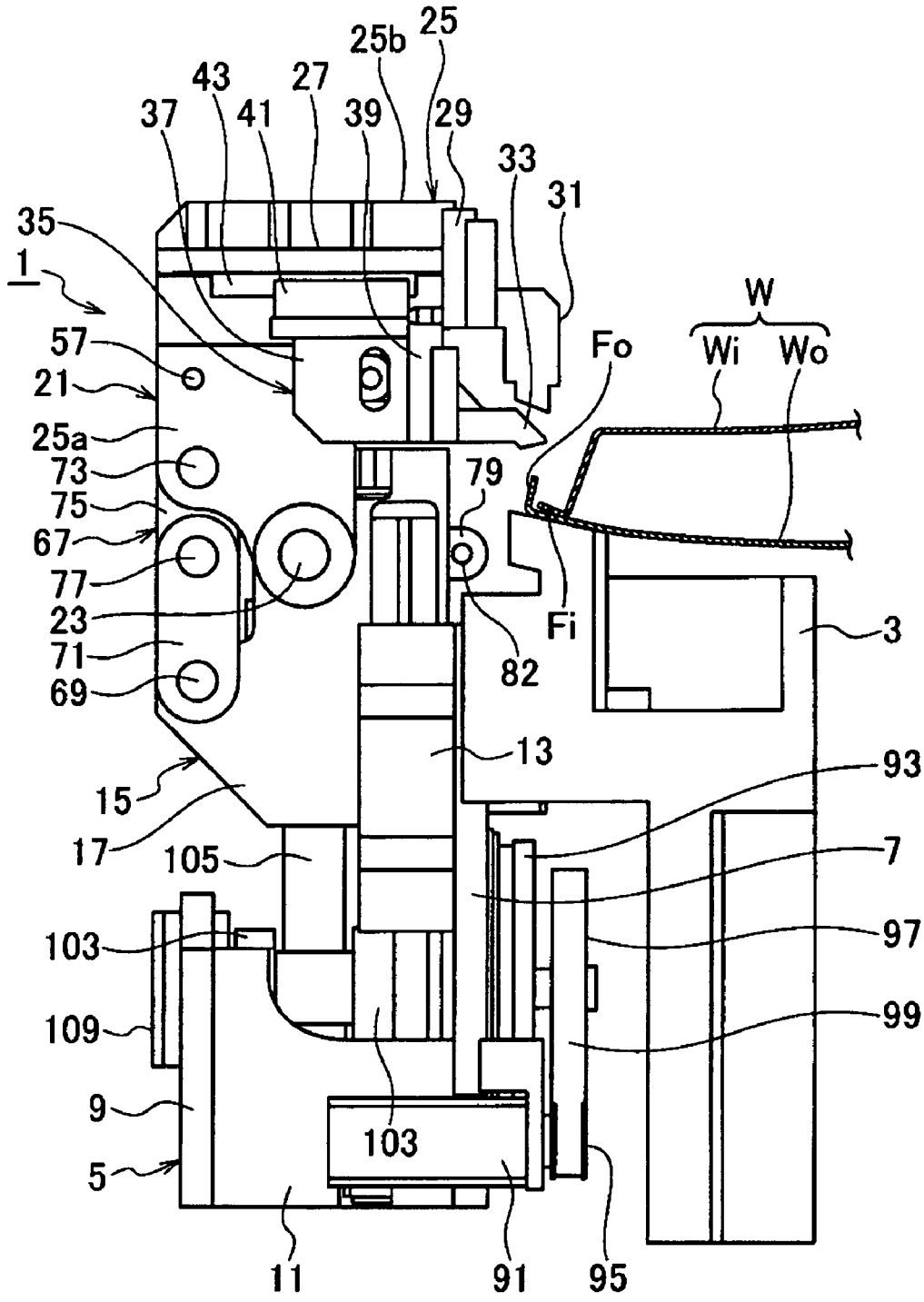
FIG. 12 is a front elevational view of the hemming machine illustrated in FIGS. 1 to 5 in accordance with the illustrated embodiment of the present invention, in which the hemming machine is in a standby state to begin a pre-hemming process.

From the state shown in FIG. 12, the servomotor 91 drives the toggle link mechanism 101, which is shown in FIG. 10. At this time, the drive side linear links 103 of the toggle link mechanism 101 rotate counterclockwise in FIG. 10 about the output shaft 107 of the reduction gear 93. This causes the follower side bent link 105 to rotate about the upper part coupling shaft 111 and to descend. Thus, the vertical slide frame 15 descends along with the hemming tool mounting bracket 21.

The descent of the hemming tool mounting bracket 21 together with the descent of the vertical slide frame 15 causes the pre-hemming tool mounting bracket 35 to also descend. Since the pre-hemming tool mounting bracket 35 has the pre-hemming tool 33 mounted thereto, the descent of the hemming tool mounting bracket 21 and the vertical slide frame 15 causes the pre-hemming tool 33 to also descend. Thus, the pre-hemming process is thereby performed between the pre-hemming tool 33 and the die 3, as shown in FIG. 1. In the pre-hemming process, the edge part Fo of the outer panel Wo transitions from the substantially 90° folded state shown in FIG. 11 to the approximately 45° folded state.

After the pre-hemming process, the servomotor 91 is rotated in a direction that is the reverse of that mentioned above, and thereby the vertical slide frame 15 is raised along with the hemming tool mounting bracket 21. The pre-hemming tool 33 is also raised and spaced apart from the workpiece W to the position shown in FIG. 12. Furthermore, from this position, the pre-hemming tool 33 is moved in the left direction of FIG. 12 so that it retracts.

The movement by which the pre-hemming tool 33 retracts is performed by driving the pre-hemming tool slide cylinder 45 so that it retracts, which displaces members from the solid line position to the chain double dashed line position in FIG. 7. Thus, the pre-hemming tool 33 retracts from the position above the workpiece W and transitions to a state where it is spaced apart from the workpiece W.

Figure 13:
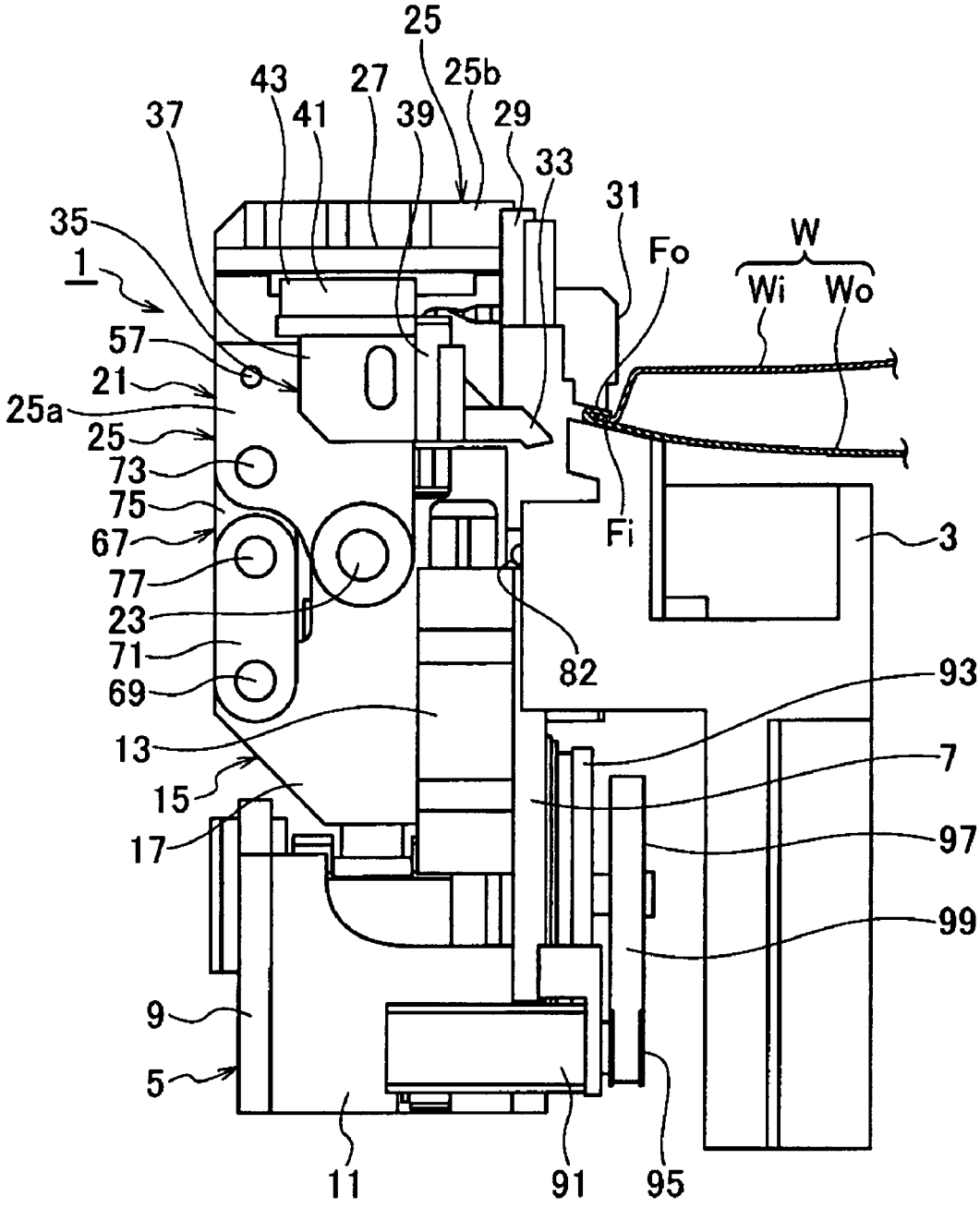
FIG. 13 a front elevational view of the hemming machine illustrated in FIGS. 1 to 5 in accordance with the illustrated embodiment of the present invention, in which the hemming machine is in a state to begin a main hemming process.

Starting from this state, the servomotor 91 drives the toggle link mechanism 101, in the same manner as during the pre-hemming process discussed above, such that the vertical slide frame 15 descends along with the hemming tool mounting bracket 21 and the hemming tool 31. Thus, the hemming tool 31 presses downward against the edge part Fo of the outer panel Wo, as shown in FIG. 13. In other words, the main hemming process is performed between the hemming tool 31 and the die 3. As a result, the edge part Fo of the outer panel Wo and the edge part Fi of the inner panel Wi are overlapped, and the hemming process is therefore complete.

After the main hemming process, the servomotor 91 generates a reverse drive, in which the hemming tool 31 is raised with respect to the main frame 5 along with the vertical slide frame 15 and the hemming tool mounting bracket 21. Also the forward drive of the swing cylinder 79 then rotates the hemming tool 31 and the pre-hemming tool 33, along with the hemming tool mounting bracket 21 and the pre-hemming tool mounting bracket 35, about the bracket coupling shaft 23 with respect to the vertical slide frame 15, thereby transitioning to the state that is the same as that shown in FIG. 11.

Furthermore, after processing the workpiece W, it is clamped by the work clamps 117 of the work grasping hand 115, which are shown in FIG. 6. After which the hand changer cover 119 is removed. Then, in a state in which the arm of the robot is coupled to the hand changer, the robot transports the work grasping hand 115. Thus, the workpiece W is removed from the die 3, which awaits the loading of the next workpiece W.

After the hemming tool 31 and the pre-hemming tool 33 are drawn near to the workpiece W by the swing operation about the bracket coupling shaft 23 of the hemming tool mounting bracket 21, the movement of the vertical slide frame 15 with respect to the workpiece W is limited to vertical linear motion during the pre-hemming process and the main hemming process. Accordingly, the stroke of that linear motion is short and it is therefore possible to prevent an increase in the overall size of the equipment in the vertical height direction, which facilitates the work of loading and unloading the workpiece W.

Furthermore, in the hemming process described above, the entire perimeter of the workpiece W can be hemmed at once by simultaneously operating a plurality of hemming machines 1, as shown in FIG. 6.

The following explains the method of performing the inspection work with respect to the hemming machine 1. As shown in FIG. 8, the inspection work is performed by dividing the clevis 85, which couples the swing cylinder 79 and the link mechanism 67 (comprising the lower part links 71 and the upper part links 75), into the segment member 88 on the side of the piston rod 83 and the segment member 89 on the side of the link support shaft 77.

At this time, starting from the state shown in FIG. 11, by removing the bolts 90, the lower part links 71 further rotates counterclockwise in FIG. 11 about the rotary support shafts 69 so that the segment member 89 on the side of the link support shaft 77 is spaced apart from the segment member 88 on the side of the piston rod 83. At this time, the hemming tool mounting bracket 21 is left coupled to the link support shaft 77, as in the state shown in FIGS. 14 and 15.

Figure 14:
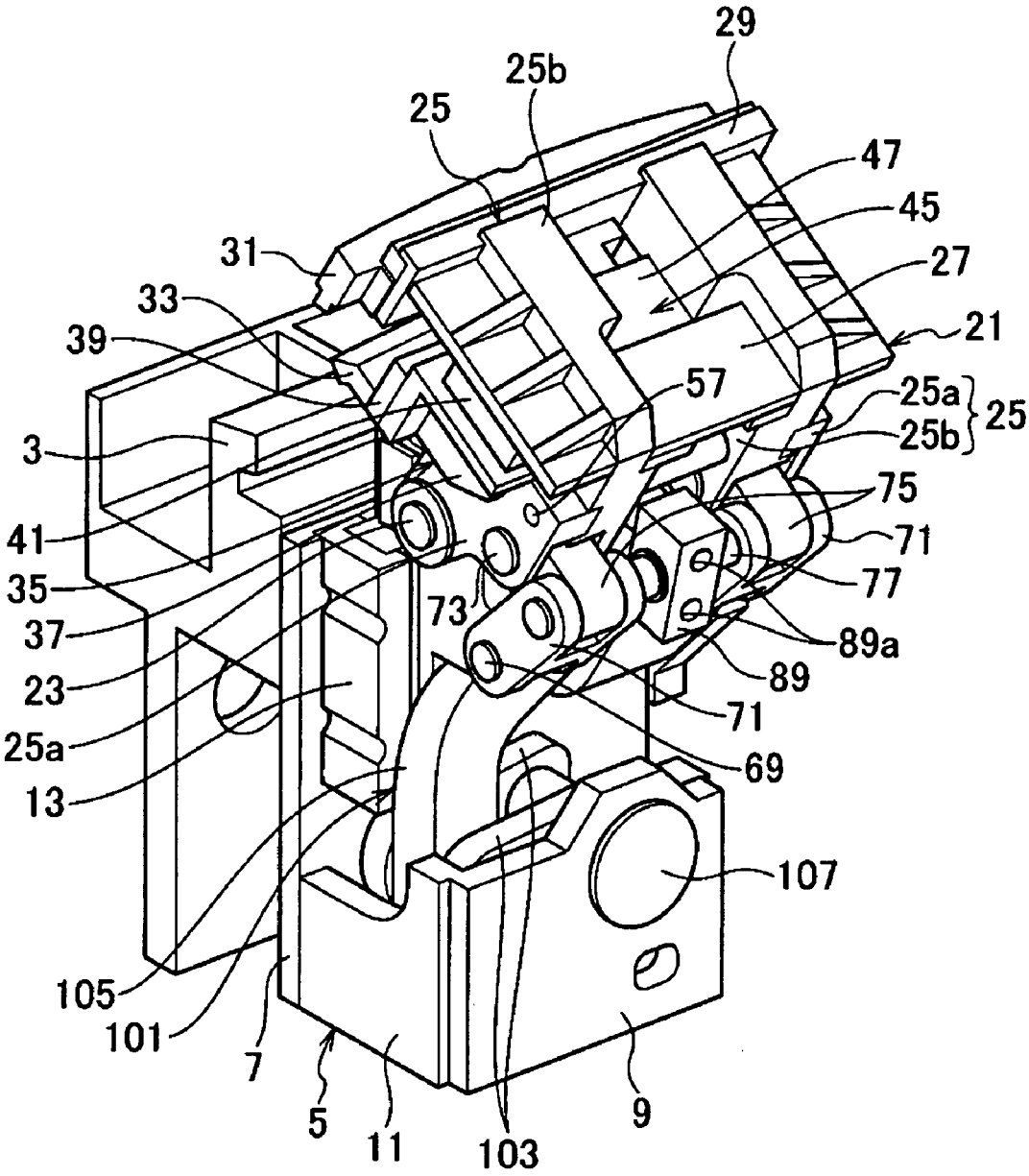
FIG. 14 is a perspective view of the hemming machine illustrated in FIGS. 1 to 5 in accordance with the illustrated embodiment of the present invention, in which the hemming machine is in a state in which the hemming tool mounting bracket is released from the swing driving structure and a clevis is divided in two parts.
Figure 15:
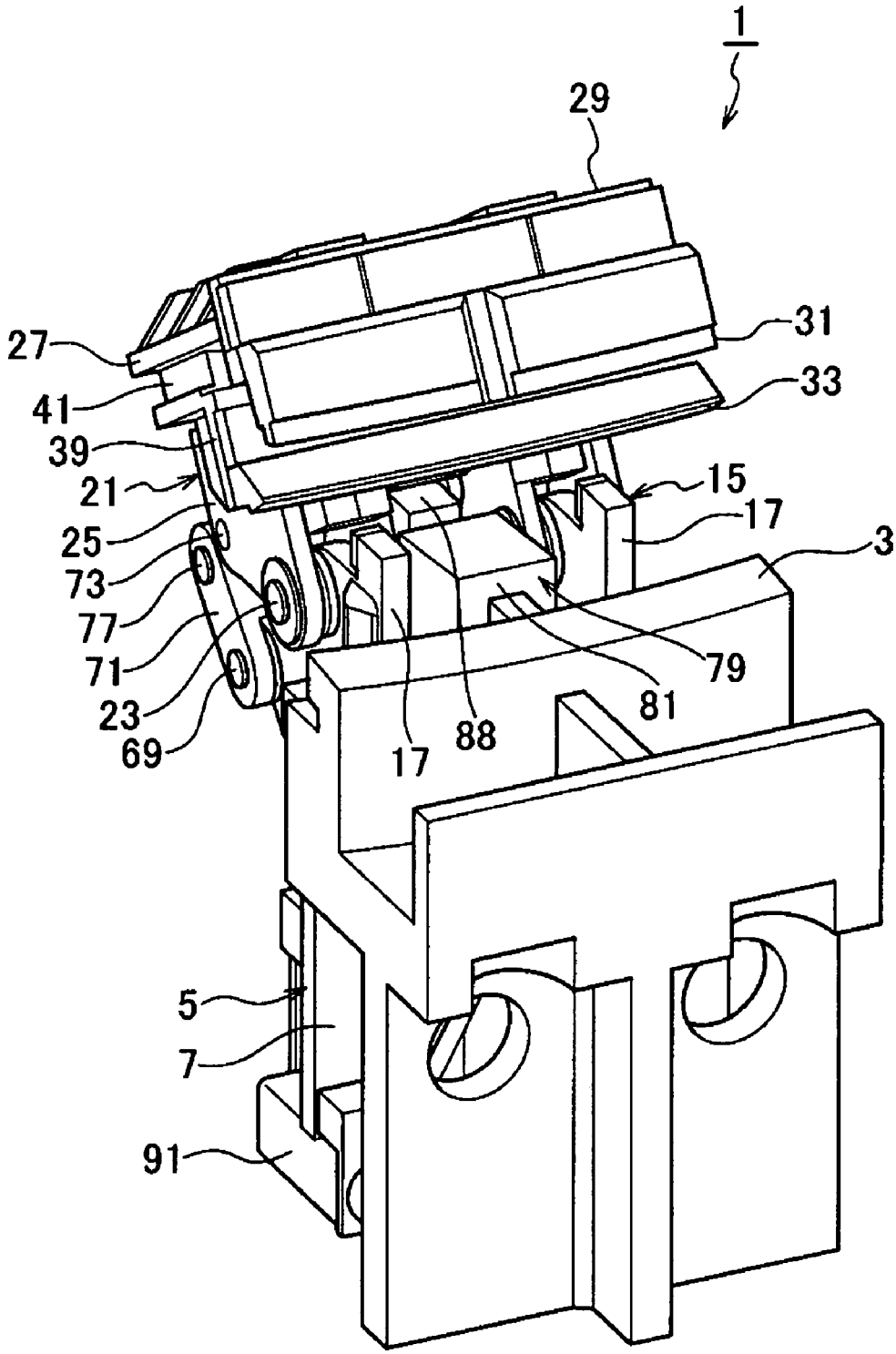
FIG. 15 of the hemming machine illustrated in FIGS. 1 to 5 in accordance with the illustrated embodiment of the present invention, as viewed from the opposite side from FIG. 14.

Accordingly, by dividing the clevis 85, as mentioned above, into the segment member 88 on the side of the piston rod 83 and the segment member 89 on the side of the link support shaft 77, the lower part links 71 rotates so that they open widely to the outer side. The hemming tool mounting bracket 21, which is coupled to the link support shaft 77, is greatly spaced apart from the die 3 and transitions to a wide opening angle with respect to the die 3, as shown in FIGS. 14 and 15.

As a result, when the hemming tool 31 or the pre-hemming tool 33 wears down and requires adjustment, the adjustment work can be performed with the hemming tool 31 and the pre-hemming tool 33 attached to the hemming machine 1, i.e., without having to remove them. In addition, the work of replacing the swing cylinder 79 can also be performed easily. Thus, work efficiency of inspecting the hemming machines 1 is improved.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A hemming machine comprising:

a frame;

a hemming tool support structure rotatably coupled to the frame to rotate about a center rotation axis, the hemming tool support structure including a hemming tool disposed at a first location such that the hemming tool moves towards and away from an edge part of a workpiece that is supported on a die upon rotation of the hemming tool support structure about the center rotation axis; and a swinging drive structure operatively arranged between the frame and the hemming tool support structure to transmit a rotational driving force to the hemming tool support structure via a releasable connection located on a side of the center rotation axis that is opposite of the hemming tool, the releasable connection being configured to release the swinging drive structure to allow further rotational movement of the hemming tool away from the die, the releasable connection including a first segment member attached to the swinging drive structure, and a second segment member attached to the hemming tool support structure, with the first and second segment members being detachable and reattachable by a coupler.

2. The hemming machine as recited in claim 1, wherein the hemming tool support structure further includes a link mechanism coupled between the hemming tool support structure and the frame, with the releasable connection coupling the swinging drive structure to the link mechanism.

3. The hemming machine as recited in claim 1, wherein the swinging drive structure is rotatable about a rotary support shaft, which is parallel to the center rotation axis.

4. The hemming machine as recited in claim 1, wherein the releasable connection is divided into a first part and a second part upon releasing the swinging drive structure.

5. The hemming machine as recited in claim 1, wherein the hemming tool support structure further includes a pre-hemming tool movably mounted to move between a non-working position and the working position.

6. A hemming machine comprising:

a frame;

a hemming tool support structure rotatably coupled to the frame to rotate about a center rotation axis, the hemming tool support structure including a hemming tool disposed at a first location such that the hemming tool moves towards and away from an edge part of a workpiece that is supported on a die upon rotation of the hemming tool support structure about the center rotation axis, and a link mechanism coupled between the hemming tool support structure and the frame, and the link mechanism including a link support shaft, a first link having a first end rotatably coupled to the frame and a second end rotatably coupled to the link support shaft, and a second link having a first end rotatably coupled to the hemming tool support structure and a second end rotatably coupled to the link support shaft; and a swinging drive structure operatively arranged between the frame and the hemming tool support structure to transmit a rotational driving force to the hemming tool support structure via a releasable connection located on a side of the center rotation axis that is opposite of the hemming tool, the releasable connection being configured to release the swinging drive structure to allow further rotational movement of the hemming tool away from the die and to couple the swinging drive structure to the link support shaft of the link mechanism.

7. A hemming machine comprising:

a frame;

a hemming tool support structure rotatably coupled to the frame to rotate about a center rotation axis, the hemming tool support structure including a hemming tool disposed at a first location such that the hemming tool moves towards and away from an edge part of a workpiece that is supported on a die upon rotation of the hemming tool support structure about the center rotation axis; and a swinging drive structure operatively arranged between the frame and the hemming tool support structure to transmit a rotational driving force to the hemming tool support structure via a releasable connection located on a side of the center rotation axis that is opposite of the hemming tool, the releasable connection being configured to release the swinging drive structure to allow further rotational movement of the hemming tool away from the die, and the swinging drive structure including a drive member and a drive rod attached to the drive member to selectively reciprocate back and forth, with the releasable connection attached at a tip end of the drive rod.

8. The hemming machine as recited in claim 7, wherein the releasable connection is divided into a drive rod part and a hemming tool support structure part upon releasing the swinging drive structure.

9. A hemming machine comprising:

frame means for providing support;

hemming tool means, rotatably coupled to the frame means about a center rotation axis, for moving towards and away from an edge part of a workpiece that is supported on a die upon rotation of the hemming tool means about the center rotation axis;

swinging drive means, operatively arranged between the frame means and the hemming tool means, for transmitting a rotational driving force to the hemming tool means; and releasable connecting means, located on a side of the center rotation axis that is opposite of the workpiece, for releasing the swinging drive means to allow further rotational movement of the hemming means away from the die, the releasable connecting means including a first segment member attached to the swinging drive means, and a second segment member attached to the hemming tool means, with the first and second segment members being detachable and reattachable by coupling means.

10. A method of inspecting a hemming machine having a hemming tool support structure rotatably coupled to a frame to rotate about a center rotation axis using a swing drive structure that is operatively arranged between the frame and the hemming tool support structure to transmit a rotational driving force to the hemming tool support structure in which a hemming tool of the hemming tool support structure near an edge part of a workpiece that is supported on a die, the method comprising:

releasing the swinging drive structure from the hemming tool support structure by dividing a releasable connection of the swinging drive structure into first and second parts by detaching a coupler, with the first part being attached to the swinging drive structure and the second part being attached to the hemming tool support structure;

rotating the hemming tool support structure in a direction so that the hemming tool is spaced further apart from the die to an inspection position by dividing the first and second parts of the releasable connection;

inspecting the hemming machine while in the inspection position; and reattaching the first and second parts of the releasable connection by attaching the coupler between the first and second parts.

* * * * *